US006250229B1

(12) United States Patent
Kerdraon et al.

(10) Patent No.: US 6,250,229 B1
(45) Date of Patent: Jun. 26, 2001

(54) PERFORMANCE EXPLOSIVE-FORMED PROJECTILE

(75) Inventors: Alain Kerdraon, Bourges; Michel Vives, Saint Ambroix, both of (FR)

(73) Assignee: Giat Industries, Versailles Cedex (FR)

( * ) Notice: Subject to any disclaimer, the term of this patent is extended or adjusted under 35 U.S.C. 154(b) by 373 days.

(21) Appl. No.: 08/999,684

(22) Filed: Dec. 11, 1997

(51) Int. Cl.[7] ..... F42B 12/10
(52) U.S. Cl. ..... 102/476; 102/501
(58) Field of Search ..... 102/306–310, 102/476, 501

(56) References Cited

U.S. PATENT DOCUMENTS 4,922,825 * 5/1990 Aubay et al. ..... 102/476
5,033,387 * 7/1991 Lips ..... 102/306
5,744,747 * 4/1998 Renaud-Bezot et al. ..... 102/476
5,792,980 * 8/1998 Weimann ..... 102/476

FOREIGN PATENT DOCUMENTS

437992 * 7/1991 (EP) ..... 102/501
2627580 8/1989 (FR) .
2654821 5/1991 (FR) .
2681677 * 3/1993 (FR) ..... 102/476

* cited by examiner

*Primary Examiner*—Harold J. Tudor
(74) *Attorney, Agent, or Firm*—Oliff & Berridge, PLC

(57) ABSTRACT

The charge of the invention comprises a plate placed between the explosive charge and the liner. The diameter of the plate is equal to the internal diameter of the casing of the charge. The material used for the plate must be such that its density is lower than or equal to that of the material used for the liner and must have a volumetric compressibility modulus greater than or equal to 100 GPa, with the thickness of the plate greater than or equal to that of the liner at any point of a central area surrounding the axis of the charge, so as to ensure that upon initiation of the charge the centripetal deformation of the plate will be less than that of the liner.

14 Claims, 3 Drawing Sheets

PERFORMANCE EXPLOSIVE-FORMED PROJECTILE

BACKGROUND OF THE INVENTION

The technical area of this invention is that of charges generating explosively-formed penetrators.

These charges generally comprise an explosive set in a casing and at least one liner having overall the form of a spherical cap.

When the explosive is detonated, the liner is set in motion by the incident pressure wave. It reshapes itself by turning back on itself like a "glove finger", that is, it transforms itself into a projectile (or slug) whose forward part comprises the central area of the liner while the rear part is a skirt formed by the periphery of the liner. Patent FR2627580 describes such a charge.

The penetrator generating charge is generally initiated at a considerable distance from the target (50 to 100 calibers from the charge). It is thus essential that the projectile's geometry enable it to remain stable along its trajectory.

In fact, destabilization of the projectile will result in the projectile's inability to reach the target at the desired place and will make it insufficiently effective.

To ensure the stabilization, normally, one seeks to give the projectile a geometry comprising a stabilizing skirt in its rear part with its center of gravity as far forward as possible.

Patent FR2654821 thus describes a charge generating an explosively-formed penetrator in which the liner, specifically at its periphery, comprises a layer of less dense material which forms a stabilizing skirt.

This solution is complicated to implement and does not allow for reproducibility of the geometric characteristics of the rear skirting.

The skirting's material comes from the periphery of the liner located near the casing of the charge.

When the charge is initiated, in this peripheral area, reflections of detonating waves are produced which most often result in an accumulation of liner material in the form of skirting of irregular shape whose mass is too great and which destabilizes the projectile.

Control over the skirting is all the more intricate when the liner is made of a material such as Tantalum whose plastic flow stress is essentially constant or decreases as a function of the strain applied to it.

In fact, with such materials, an increase in strain quickly leads to rupture. It is then impossible to elongate the projectile so as to place its center of gravity as far forward as possible while ensuring the formation of skirting of reproducible form.

The goal of this invention is to offer a charge generating an explosively-formed penetrator which is free of these disadvantages.

Thus, the charge according to this invention generates a projectile whose skirt geometry and mass distribution are controlled.

The structure of the charge according to the invention is also very simple and inexpensive to manufacture.

The purpose of the invention is thus a charge generating an explosively-formed penetrator comprising an explosive placed in a casing and at least one liner having the diameter of the casing and which is intended to be set in motion by the detonation of the explosive, with the charge characterized in that it comprises a plate positioned between the explosive and the liner, and this plate's diameter will be equal to that of the casing's internal diameter and this plate will completely cover the surface of the liner placed opposite the explosive and with the material for the plate having a density equal to or lower than the material of the liner and a volumetric compressibility modulus greater than or equal to 100 GPa, with the thickness of the plate being greater than or equal to that of the liner at any point of a central area surrounding the axis of the charge—in order to ensure, at initiation of the charge, a centripetal deformation of the plate which will be less than that of the liner.

Preferably, the diameter of the central area should be greater than or equal to 75% of the diameter of the liner or of the plate (caliber of the charge).

The liner can be made of a material with a plastic flow stress which is essentially constant or which decreases as a function of strain.

The plate's thickness can be essentially constant or, again, increasing from its periphery going toward the axis of the charge.

The liner material can be of any of the following: Tantalum, Molybdenum, Nickel or Copper, and the plate can be made of Aluminum or Magnesium.

In the central area, the thickness of the plate can be greater than or equal to 50% of that of the liner where it forms a right angle with that particular plate.

The external bending radius of the liner can be between 0.7 and 1.5 times its external diameter.

BRIEF DESCRIPTION OF THE DRAWINGS

This invention can be better understood with a reading of the description which follows of the various embodiments. This description refers to the annexed drawings in which.

DESCRIPTION OF THE PREFERRED EMBODIMENTS

Figure 1:
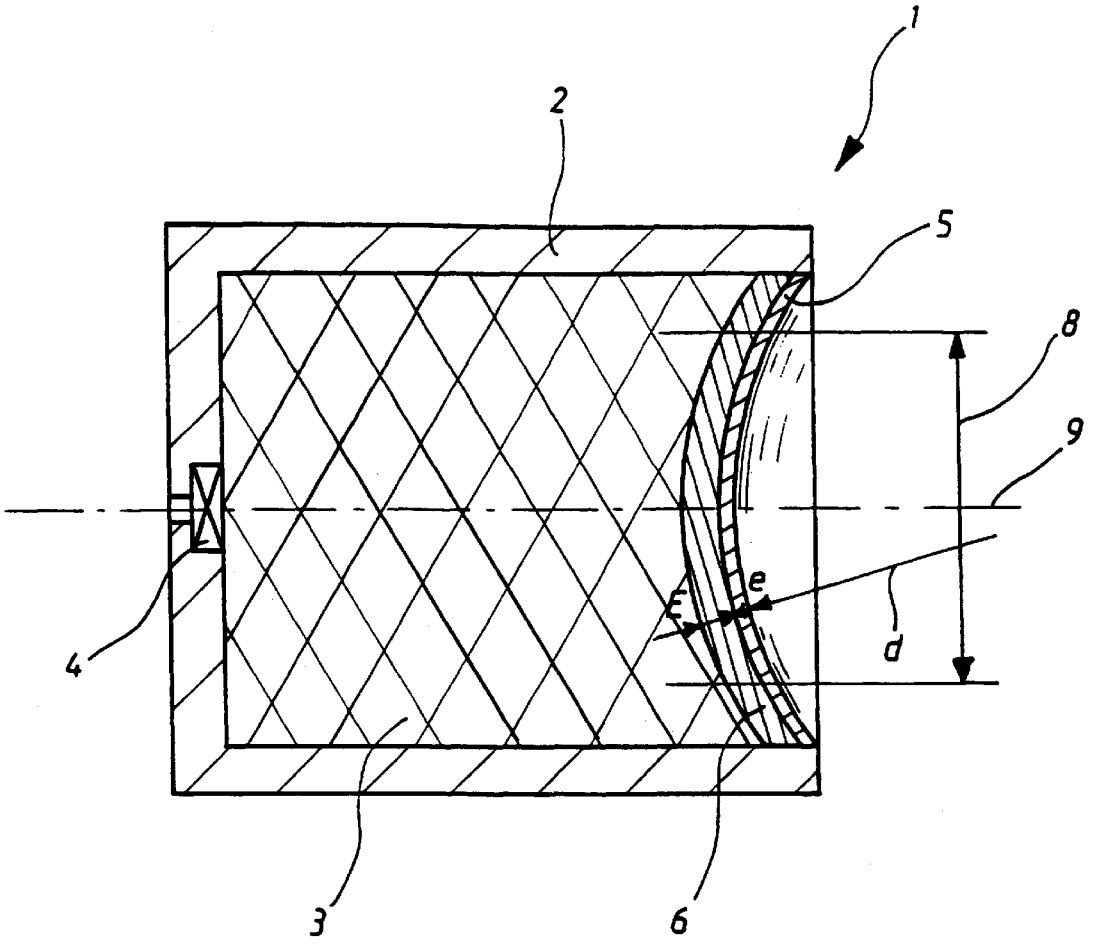
FIG. 1 is a longitudinal cross-section of a charge generating an explosively-formed projectile according to a first embodiment of this invention.

With respect to FIG. 1, a projectile-generating charge 1 according to a first embodiment of this invention comprises a cylindrical casing 2 into which is placed an explosive 3 intended to be initiated by initiating means 4 comprising, for example, a fuze and a relay explosive.

This charge also comprises a liner 5, made of, for example, Tantalum and it is separated from the explosive 3 by a plate 6.

The diameter of the plate 6 is equal to the internal diameter of the casing 2, and it is in contact with the liner 5 and completely covers its surface. The material for the plate must have a density equal to or lower than the material of the liner and a volumetric compressibility modulus greater than or equal to 100 GPa, The density of the material of the plate must be less than that of the liner so that the latter can receive the major part of the energy generated by the explosive.

In practice, the material chosen should have the lowest density possible and preferably the charge should be sized such that the liner will amount to 65% to 80% of the total mass of the liner and plate together.

The volumetric compressibility modulus (Kv) is a pressure consistent number which is also, for a given material, the ratio of pressure variation to the relative variation in volume caused by this variation in pressure ($Kv=Vo\times(P-Po)/(V-Vo)$).

This modulus should be greater than or equal to 100 GPa so that the plate material, under the effect of the explosive can:

on the one hand, behave analogously to the liner of the projectile-generating charge, that is, it should turn back on itself like a "glove finger", also offer enough resistance to centripetal deformation to be able to maintain, after deformation, a high diameter (D) in its forward part 7 (from 0.25 to 0.3 caliber or diameter of the plate).

This arrangement also allows the plate to absorb part of the shock waves coming from the explosive, specifically at the periphery. The liner 5 is thus insulated against shock wave reflections at its periphery, which interfere with the formation of the skirting.

For example, a liner made of Tantalum, or Molybdenum, of nickel or of copper could be used with a plate of aluminum or of magnesium.

A liner of nickel could also be used with a plate of magnesium.

The thickness of the plate will be greater than or equal to that of the liner along all points of a central area 8 surrounding the axis 9 of the charge, an area whose diameter is greater than or equal to 75% of the caliber of the charge.

Thus, in this central area 8, in any normal direction d over the external surfaces of the plate and the liner, the thickness E of the plate will be greater than the thickness e of the liner facing it at any point measured.

This arrangement ensures that centripetal deformation will be more difficult for the plate than for the liner.

The result is that the plate forms a thick "slug" whose skirt flares out wider than that of the liner. The forward part 7 of the deformed plate has a wide diameter (from 0.25 to 0.3 of the caliber of the plate).

The thickness E of the plate will of course be such that its material can deform without rupture when the charge is initiated.

For example, it would be possible to have an aluminum plate of a constant thickness of about 5 mm used in conjunction with a Tantalum liner with a constant thickness of about 2 mm.

Figure 2A:
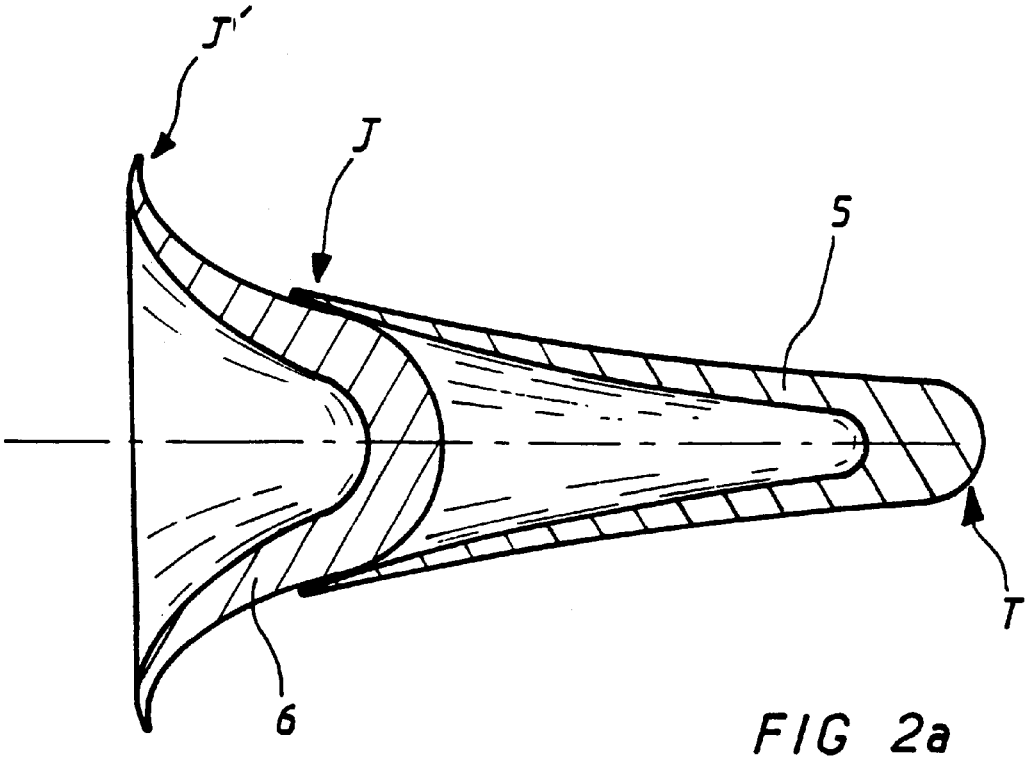
FIGS. 2*a* and 2*b* are schematic representations of two successive stages in the formation of the charge's projectile shown in FIG. 1.

FIG. 2*a* shows an initial stage in the formation of the projectile out of the liner 5.

When the charge is initiated, the shock wave generated by the explosive crosses the plate 6 and reaches the liner 5 with little attenuation (because of the low density of the plate and its high volumetric compressibility modulus).

As a result, the liner 5 is deformed. Its central part, which receives the first shock wave, is the first part to be thrown and forms the head T of the projectile.

The periphery of the liner 5 forms the skirting J. The plate 6 also deforms under the effect of the detonation. It occurs along with the deformation of the liner, while its low density keeps it up against the liner's heavier material.

The thickness of the plate 6 in its central area 8 reduces the chances of centripetal deformation. The result is the formation of a thick projectile with a skirt J' whose diameter is greater than that of the skirt J and a forward part 7 of the plate 7 has its diameter considerably deformed (0.25 to 0.3 caliber). The plate 6 is thus transformed into a grossly conical support whose forward part 7 forms a support for the skirt J of the projectile made out of the liner 5.

The skirt J is thus both protected and formed by the plate 6.

The result is the formation of a skirt J which is more gradually flaring and more reproducible than was the case with prior art charges.

With the plate 6 protecting and accompanying the deformation of the liner 5, it becomes possible to give the liner 5 a lower bending radius. It is thus possible using this means to produce a lengthening of the upper projectile and a movement of the mass of the projectile toward its head T.

This particular property is especially useful with liners of materials whose plastic flow stress is essentially constant or decreases as a function of deformation (with Tantalum, for example).

In fact, it is not possible to give a liner 5 of such material a bending ratio of less than 1 caliber, because the result would be too much striction in the middle part of the projectile, which would cause it to rupture.

The use of the plate 6 allows for reduction of this radius by about 15%, thus enabling the projectile to travel at about 2200 m/s.

It is to be noted that this increase in velocity easily compensates for the loss in energy resulting from the presence of the plate.

This invention thus makes possible total control over the formation of the projectile made of a material whose plastic flow is essentially constant or decreases as a function of the strain applied to it (such as Tantalum).

The difference in diameter between the skirt J' of the projectile issuing from the plate 6 and the skirt of the projectile issuing from the liner 5 increases aerodynamic drag for the plate 6.

Figure 2B:
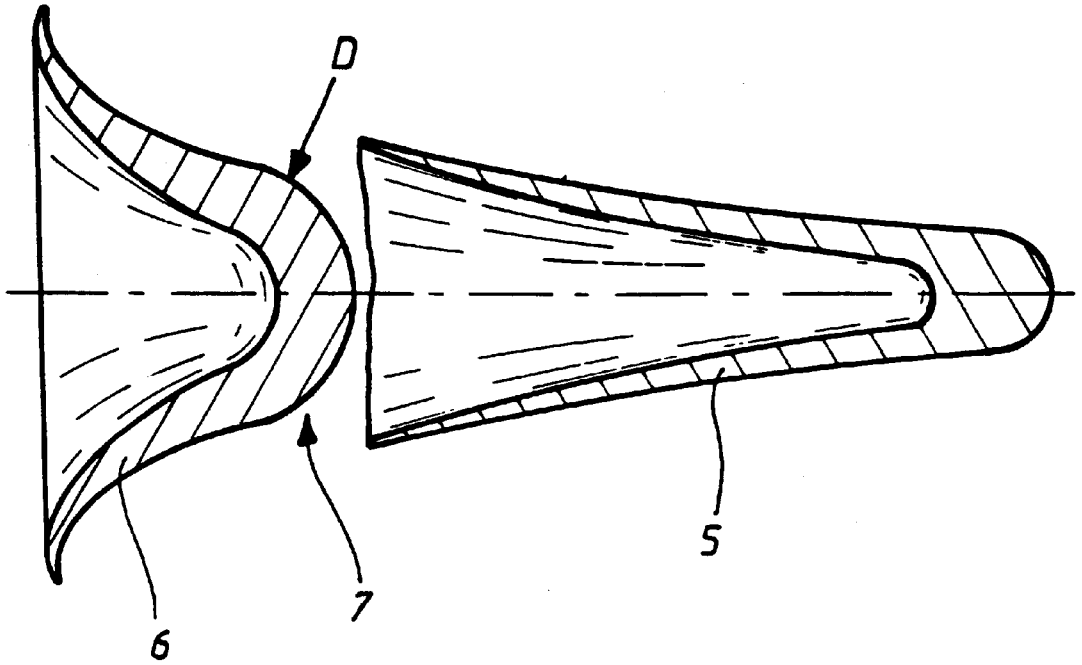

The plate thus separates rapidly from the projectile 5 and does not interfere with its flight (Cf FIG. 2*b*).

To promote the formation of the skirting of the liner 5 and the separation of the plate 6 from the liner 5, a lubricating material can be placed between the plate 6 and the liner 5. One could, for example, place there some Teflon (Poly tetrafluorethylene) or silicone lubricant.

Figure 3:
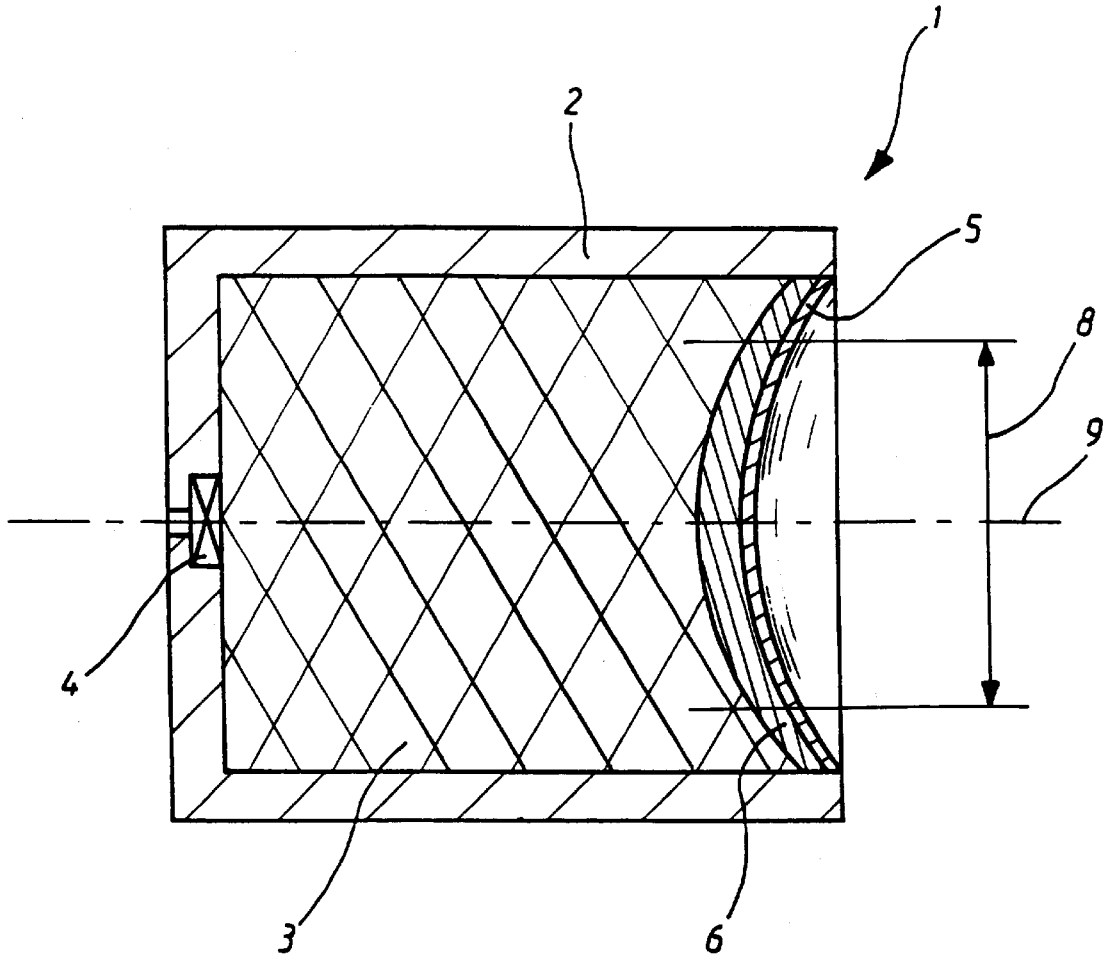
FIG. 3 is a longitudinal cross-section of a projectile-generating charge according to a second embodiment of this invention.

FIG. 3 shows a second embodiment of a charge 1 according to this invention.

This charge is different from its predecessor in that the thickness of the plate 6 increases going from the periphery toward the axis of the charge 9. The liner 5 is still of constant thickness and the thickness of the plate is still greater than that of the liner at any point in the central area 8 surrounding the axis of the charge 9.

This variance in the thickness of the plate 6 makes it possible, at the moment of initiation of the charge, to increase the velocity differential which exists between the periphery of the liner 5 and its central part. The result is a greater lengthening of the projectile formed by the liner 5.

As before, the plate supports the liner. It protects the skirting and promotes its formation.

It could be possible to have a plate 6 thickness which is lesser than that of the liner 5 at the peripheral area close to the casing 2 in order to increase further the lengthening of the projectile.

The charge according to this invention makes it possible to control the geometric characteristics of the projectile quite economically.

In fact, the known solutions generally rely on localized machining of the liner to guide its deformation and the geometry of the projectile obtained.

With this invention this machining serves no purpose because the form of the projectile will depend essentially on the plate 6 and, in particular, on the variance in its thickness.

In addition, this invention makes it possible to obtain a projectile whose level of performance remains the same despite the use of a liner 5 of lower mass. The result is an economy in the liner material.

As a variant, it should be noted that it is possible to use a liner of variable thickness. For example, it would be possible to increase its thickness going from the periphery toward the liner's axis in such a way as to give the projectile a favorable mass distribution (the forward part of the projectile would be heavier than the rear part).

This invention could also be implemented with a charge comprising a stack of several liners.

What is claimed is:

1. A projectile generating charge, comprising:

a casing having a central axis;

an explosive placed in the casing;

a liner proximate one end of the casing, the liner set in motion by a detonation of the explosive;

a plate positioned between the explosive and the liner, the plate having a diameter equal to an internal diameter of the casing and completely covering a surface of the liner, a material of the plate having a density less than or equal to that of a material of the liner and having a volumetric compressibility modulus greater than or equal to 100 GPa, and a thickness of the plate in a central area is greater than or equal to a thickness of the liner in the central area to provide, at the detonation of the explosive, a the diameter of the central area is greater than or equal to 75% of the diameter of the liner or of the plate.

2. The projectile generating charge according to claim 1, wherein the liner is of a material whose plastic flow stress is essentially constant or decreases as a function of deformation.

3. The projectile generating charge according to claim 2, wherein the material used for the liner is one selected from the group consisting of Tantalum, Molybdenum, Nickel or Copper and the material of the plate is one of Aluminum or Magnesium.

4. The projectile generating charge according to claim 2, wherein the thickness of the plate is essentially constant.

5. The projectile generating charge according to claim 4, wherein the material used for the liner is one selected from the group consisting of Tantalum, Molybdenum, Nickel or Copper and the material of the plate is one of Aluminum or Magnesium.

6. The projectile generating charge according to claim 2, wherein the thickness of the plate increases going from its periphery toward the central axis of the casing.

7. The projectile generating charge according to claim 6, wherein the material used for the liner is one selected from the group consisting of Tantalum, Molybdenum, Nickel or Copper and the material of the plate is one of Aluminum or Magnesium.

8. The projectile generating charge according to claim 2, wherein the external bending radius of the liner is between 0.7 and 1.5 times its external diameter.

9. The projectile generating charge according to claim 1, wherein the thickness of the plate is essentially constant.

10. The projectile generating charge according to claim 9, wherein the material used for the liner is one selected from the group consisting of Tantalum, Molybdenum, Nickel or Copper and the material of the plate is one of Aluminum or Magnesium.

11. The projectile generating charge according to claim 1, wherein the thickness of the plate increases going from its periphery toward the central axis of the casing.

12. The projectile generating charge according to claim 11, wherein the material used for the liner is one selected from the group consisting of Tantalum, Molybdenum, Nickel or Copper and the material of the plate is one of Aluminum or Magnesium.

13. The projectile generating charge according to claim 1, wherein the external bending radius of the liner is between 0.7 and 1.5 times its external diameter.

14. The projectile generating charge according to claim 13, wherein the material used for the liner is one selected from the group consisting of Tantalum, Molybdenum, Nickel or Copper and the material of the plate is one of Aluminum or Magnesium.

* * * * *